United States Patent [19]

Woods

[11] Patent Number: 4,909,758

[45] Date of Patent: Mar. 20, 1990

[54] ELECTRICAL POWER OUTLET ADAPTOR DEVICE

[76] Inventor: James Woods, 312 N. Independence, Mascautah, Ill. 62258

[21] Appl. No.: 211,092

[22] Filed: Jun. 8, 1988

Related U.S. Application Data

[63] Continuation of Ser. No. 881,782, Jul. 3, 1986, abandoned.

[51] Int. Cl.[4] ..... H01R 27/00

[52] U.S. Cl. ..... 439/535; 439/540; 439/650

[58] Field of Search ..... 439/535–543, 439/650, 663; 362/457

[56] References Cited

U.S. PATENT DOCUMENTS

| | | | |
|---|---|---|---|
| 1,119,839 | 12/1914 | Kuhn . | |
| 1,290,623 | 1/1919 | Marsh | 339/122 F X |
| 1,664,090 | 3/1928 | Sargeant . | |
| 2,162,265 | 6/1939 | Loomis | 173/343 |
| 2,920,303 | 6/1960 | Johnson | 339/97 |
| 3,243,587 | 3/1966 | Relich . | |
| 3,534,319 | 10/1970 | Querolo et al. | 339/91 F X |
| 3,629,789 | 12/1971 | Szeremy | 339/33 |
| 3,716,651 | 2/1973 | Werner . | |
| 3,879,101 | 4/1975 | McKissic | 339/122 R |
| 4,273,957 | 6/1981 | Kolling | 339/123 X |
| 4,336,418 | 6/1982 | Hoag | 339/122 R |
| 4,460,948 | 7/1984 | Malola | 362/368 |

*Primary Examiner*—Eugene F. Desmond

[57] ABSTRACT

Parking garages typically do not have permanent electric power outlets but do have other types of permanent electrical fixtures and fittings. An electric power outlet is mechanically and electrically connected to a removable connector half of an industrial electric fixture fitting to provide a convenient and inexpensive source of electric power for maintenance and work crews to operate power equipment. An electrical fixture is removed from its fitting and an electrical adaptor having an electric power outlet mechanically and electrically connected to a removable connector half of the electrical fixture fitting is mated to the fitting to temporarily convert the electrical fixture fitting to an electric power outlet.

15 Claims, 3 Drawing Sheets

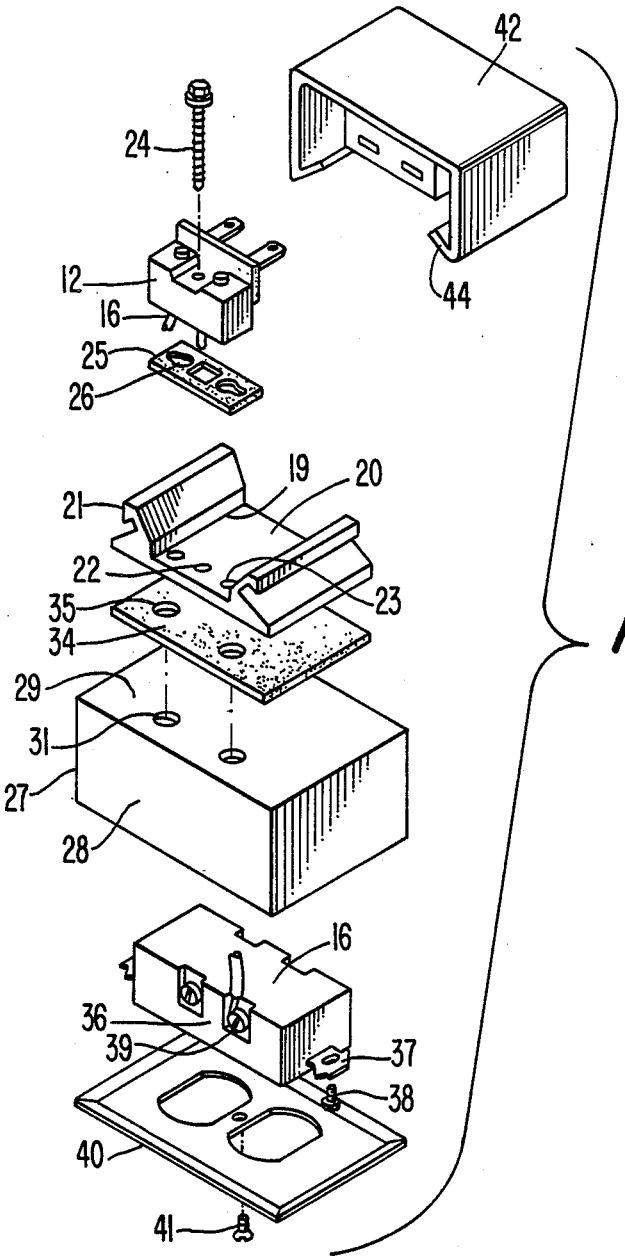
FIG. 3.
FIG. 4.
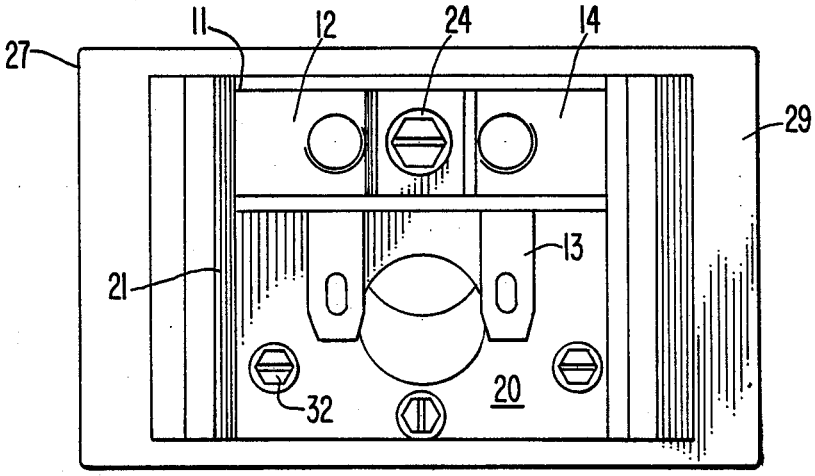

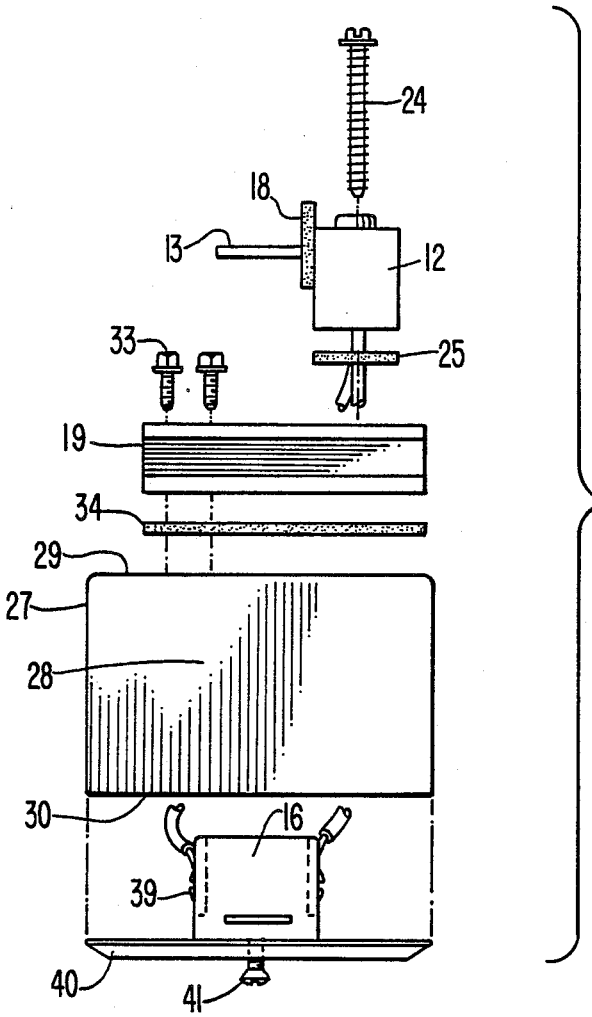
FIG. 5.
FIG. 6.
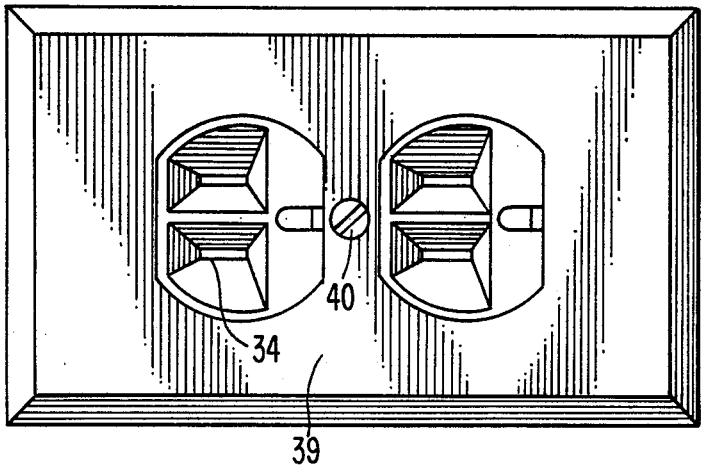

ELECTRICAL POWER OUTLET ADAPTOR DEVICE

This application is a continuation of application Ser. No. 881,782, filed July 3, 1986, now abandoned.

BACKGROUND OF THE INVENTION

The present invention relates to an electrical power outlet adaptor that is adapted for use in parking garages and other facilities were standard electric power outlets are not permanently available. An electrical adaptor made in accordance with the present invention temporarily converts a standard industrial lighting fixture fitting of the type that is typically installed in parking garages to a power outlet to provide a convenient source of electric power for use by maintenance and repair crews.

As with any other type of building, parking garages require maintenance and repair. Utilities such as lighting and plumbing systems, stairways, elevators, safety railings, and structural features of the garage require periodic attention. In addition, painting and cleaning may be needed. These activities require the use of a variety of power tools, including drills, sanders, painting compressors, lighting for work crews, etc. Maintenance and repair crews working in parking garages need a convenient source of electric power to operate tools and equipment in order to perform the necessary maintenance or repair operations. This need, however, has not been met.

Parking garages tyically do not contain permanent electric power outlets. Consequently, it is inconvenient and expensive to provide electric power to work crews in parking garages. Maintenance and repair crews working in parking garages, therefore, do not have ready access to a convenient or inexpensive source of electric power for their power tools and equipment.

Although parking garages typically contain electrical appliances and devices, such as lighting fixtures, elevators, etc., permanent electric power outlet are generally not installed in such facilities for a variety of reasons. First, apart from maintenance or repair functions, standard electric power outlets are not generally needed in a parking garage. Second, permanent electrical outlets would enable persons using the garage to make unauthorized use of the electric current supplied by these outlets. In addition, permanent electric fixtures may pose potential hazards. Toxic and explosive fumes, such as gasoline fumes, may rise to dangerous levels in parking garages. The existence or use of exposed, permanently mounted electric power outlets may pose a hazard of explosion.

Maintenance and work crews, however, need a source of electric power to operate power tools. The lack of permanent power outlets in garages has posed substantial problems. In the past people have attempted to resolve these problems in several ways. Electrical power is supplied to maintenance and work crews either through the use of extension cords from nearby electrical outlets or through the use of portable electric generating equipment. Typically, crews bring with them to a parking garage portable electric power generating equipment to provide a temporary source of electric power.

Both of these approaches, however, have significant drawbacks. The use of extension cords is expensive, cumbersome, and potentially dangerous. First, extension cords are regularly exposed to extremes of temperature, abrasion, stretching, and a multitude of other abuses. Extension cords that are able to withstand the severe use conditions in parking garage facilities are expensive. Second, extension cords can be inconvenient to use, particularly in multi-level garages. Third, the use of extension cords poses a tripping hazard to pedestrians. In addition, the extension cords typically lie on the garage floor where they are run over by vehicles and other equipment and, therefore, are vulnerable to damage. Extension cords may be cut, disconnected, or partially disconnected, exposing wires carrying live electric current and posing a potential shock or explosion hazard. Extension cords, however, canot be used in all facilities. Their use is limited to only those facilities having electric power outlets available nearby.

The most widely used alternative is portable electric generating equipment. Under this approach, maintenance or repair crews would bring with them to the facility portable electric generating equipment, such as gasoline or diesel fuel-powered generators. This equipment, however, is expensive, and is costly and difficult to maintain. Fuel must be supplied to the generating equipment. Portable electric generating equipment is prone to frequent breakdown, causing lost work time and additional expenses for replacement equipment. Crews often use backup generators, further increasing the cost of providing a source of electric power. In addition, the generating equipment is noisy and gives off noxious exhaust fumes. These factors increase the inconvenience and discomfort associated with using portable generating equipment.

These approaches do not adequately address the problem of providing a convenient, inexpensive, and easy to use source of electric power to maintenance and repair crews in parking garage facilities.

An object of the invention is to provide a convenient source of electric power to maintenance and work crews in parking garages and other facilities that are not equipped with readily available electric power outlets.

An additional object of the present invention is to provide a temporary electric power outlet in parking garages and other facilities where electric power outlets are not typically available.

A further object of the invention is to provide an inexpensive source of electric power for maintenance and work crews working in parking garages and other facilities.

An additional object of the present inventionis to eliminate the inconvenience and risk to pedestrians and users of parking garage and similar facilities posed by the use of extension cords or portable generating equipment.

A further object of the present invention is to provide a temporary source of electric power is parking garage facilities for the convenience of maintenance and work crews while avoiding the expense, inconvenience, and hazards associated with theuse of either extension cords or portable generating equipment.

Additional objects and advantages of the invention will be set forth in part in the description which follows, and in part will be obvious from the description or may be learned by practice of the invention. The objects and advantages of the invention will be realized and detailed by means of the instrumentalities and combinations particularly pointed out in the appended claims.

SUMMARY OF THE INVENTION

The present invention overcomes the disadvantages of the prior art and attains the objects of the invention by providing a readily available, inexpensive, and convenient source of electric power to maintenance and work crews, as needed. The present invention avoids the need for extension cords by providing electric power outlets in a parking garage convenient to the location where electric power is needed. Similarly, the present invention avoids the high capital and operating costs, hazards, and inconvenience of portable generating equipment by eliminating the need for such equipment.

To achieve the objects and in accordance with the purpose of the invention, as embodied and broadly described herein, the invention is an electrical adaptor for converting an electrical fixture fitting to a standard electric power outlet to which various electrical equipment can be connected by a standard electrical power plug comprising electrical connector means for mating electrically with the electrical fixture fitting, having electrical contact means for mating electrically with the electrical fixture fitting, said electrical contact means being disposed in said mated position in substantially parallel relation to the surface to which the electrical fixture fitting is mounted, and conduction means for electrically connecting said electrical contact to the standard electrical power outlet; a mounting bracket for mating mechanically with the electrical fixture fitting, said mounting bracket being disposed in said mated position in substantially parallel relation to said electrical contact means and to the surface to which the electrical fixture fitting is mounted, said mounting bracket having a flange portion along an edge of said mounting bracket for mechanically mating with the electrical fixture fitting, said flange portion being disposed in said mated position in substantially parallel relation to said electrical contact means and to the surface to which the electrical fixture fitting is mounted; first mounting means for mechanically connecting said electrical connector means to said mounting bracket; an electrical wiring box, having first and second surfaces, said first surface mechanically connected with said mounting bracket, said secondsurface in which the standard electrical power outlet is mounted; and second means for mechanically mounting said mounting bracket to said first surface of said wiring box.

It is to be understood that both the foregoing general description and the following detailed description are exemplary and explanatory only and are not restrictive of the invention as claimed.

The accompanying drawings, which are incorporated in and constitute a part of this specification, illustrate one embodiment of the invention and, together with the description, serve to explain the principles of the invention.

BRIEF DESCRIPTION OF THE DRAWINGS

FIG. 3 is an exploded view of the electrical adaptor shown in FIG. 1 in a mounting relationship to a mounting bracket of an industrial lighting fixture fitting.

FIG. 4 is a plan view of the top of the electrical adaptor shown in FIG. 1.

FIG. 5 is an exploded view of the electrical adaptor shown in FIG. 1.

FIG. 6 is a plan view of the underside of the electrical adaptor shown in FIG. 1.

DESCRIPTION OF THE PREFERRED EMBODIMENT

Reference will now be made in detail to a present preferred embodiment of the invention, an example of which is illustrated in the accompanying drawings.

Figure 1:
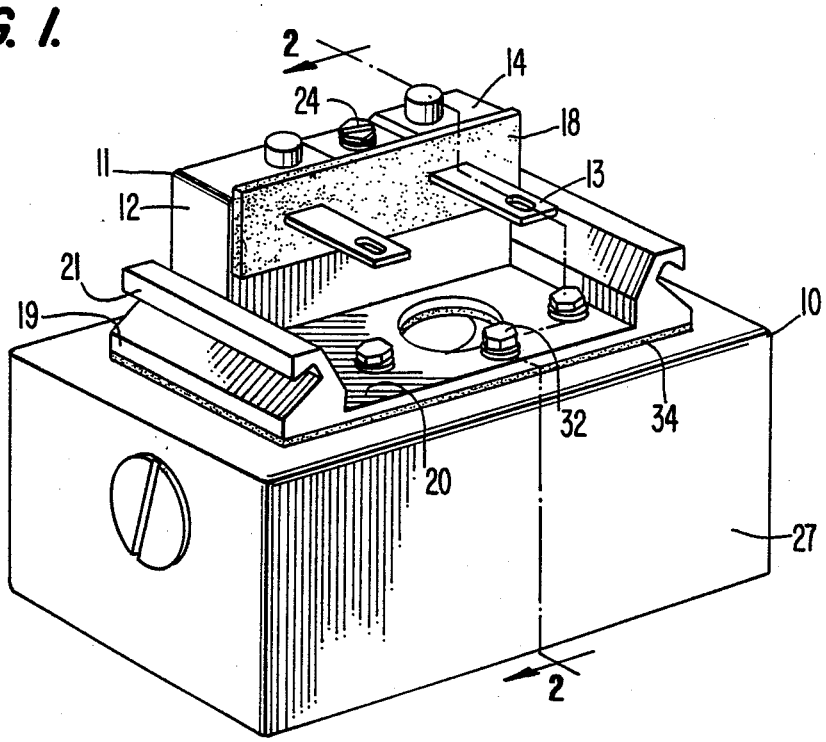
FIG. 1 is a perspective view of a preferred embodiment of the electrical adaptor of this invention.

A preferred embodiment of the invention is shown in FIG. 1 as 10. An electrical adaptor made in accordance with the present invention is connected with the mounting bracket of a standard electrical light fixture fitting in a parking garage or other facility to provide a temporary electric power outlet.

A preferred embodiment of the claimed invention can be made to be adaptable with an electrical fixture fitting such as that used with industrial lighting units manufactured by the General Electric Company, Catalog No. 01110L021. Industrial lighting fixtures can be mounted by means of a male-female mounting brcket fitting of the type listed by Underwriters Laboratory as "Listed Fixture Fitting 112D." The female half of the mounting bracket can be permanently installed in the parking garage or other facility; the male half of the fitting can be mounted on the back of the lighting fixture.

To use an electrical adaptor made in accordance with the present invention, the existing light fixture is first removed from its mounting. The female half of the fixture fitting remains in place as installed; the male half of the electrical fixture fitting is disengaged from the female half of the electrical fixture fitting when the lighting fixture is removed. The lighting fixture is replaced with an electrical adaptor made in accordance with the present invention to provide a standard electrical power outlet for maintenance and repair crews.

When the maintenance or repair crew has completed its work, the electrical adaptor made in accordance with the invention is removed from the fixture fitting and the light fixture is replaced. In this way, an electrical adaptor, as set forth and claimed herein, provides a temporary electric outlet for use by maintenance or repair crews in a parking garage or similar facility that either lacks conventional, permanent electric outlets or in which outlets may be available but are not conveniently located.

In accordance with the present invention, the electrical adapter 10 includes a connector. In a preferred embodiment of the invention, an example of the connector is shown in FIG. 1 as 11. As embodied herein, the connector comprises two components: an electrical connector element 12 and a mounting bracket 19. The connector 11 mates with the cooperating connector element 43 of the electrical fixture fitting 42 to make good electrical contact with the electrical fitting 42, as shown in FIG. 3. As embodied herein, the connector 11 is a male half of a standard industrial fixture fitting.

Figure 2:
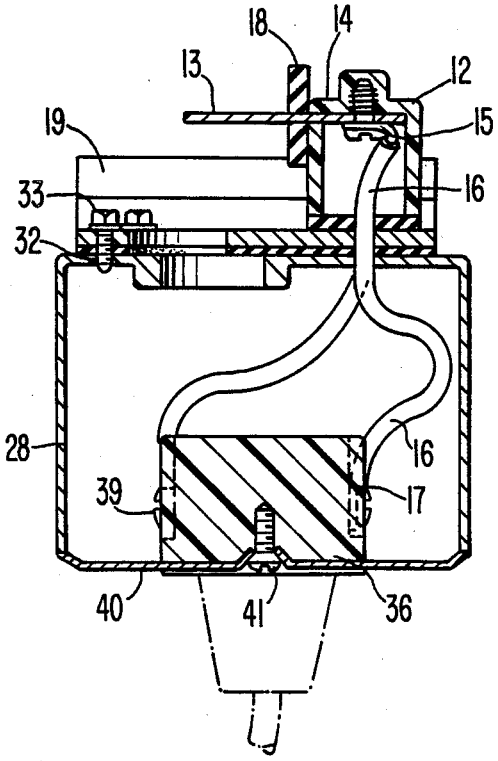
FIG. 2 is a sectional view of the electrical adapter shown in FIG. 1, taken along line 2—2.

In a preferred embodiment of the invention, the electrical connector element is shown in FIG. 2 as 12. As embodied herein, the electrical connector element 12 has one or more contacts 13, a housing 14, one or more wires 16, and an electrically insulating pad 18. As shown in FIG. 2, the contacts 13extend from the housing 14. As embodied herein, the contacts 13 mate with the corresponding electrical contact elements of the cooperating connector half 43 of the electrical fixture fitting 42, as shown in FIG. 3. The contacts 13provide good electrical contact when the connector 11 is mechanically mated to the electrical fixture fitting 42, as shown in FIG. 3.

As embodied herein, to promote good electrical contact, an electrically insulating pad 18, as shown in FIG. 2, is provided. The electrically insulating pad 18 can be mounted on the contacts 13 by sliding the electrically insulating pad over the contacts 13 until the electrically insulating pad 18 is flush with the housing 14. In this position, the electrically insulating pad 18 helps prevent shorting of the contacts, helps promote good electrical connection, and helps reduce the danger of electric shock.

In a preferred embodiment of the invention, one or more wires 16 are fixed to the contacts 13 in the housing 14 by screws 15, as shown in FIG. 2. As embodied herein, the wires 16 extend out of the housing 14. The ends of the wires 16 form output terminals 17 of the connector 11.

In a preferred embodiment of the invention, an example of the mounting bracket is shown in FIG. 3 as 19. As embodied herein, the mounting bracket has a base portion 20, flanges 21, a first mounting interface 22, and one or more apertures 23.

In a preferred embodiment of the invention, the mounting bracket may contain one or more apertures 23 to allow the wire 16 to pass through the mounting bracket 19 to facilitate electrical connection between the electrical connector element 12 and the electrical outlet 36. The arrangement of the apertures 23 permitting passage of the wires 16 through the mounting bracket 19, can be seen in FIG. 3.

In a preferred embodiment of the invention, flanges 21 are provided for mechanically mating the mounting bracket 19 of the connector 11 to the cooperating mounting bracket 44 of the electrical fixture fitting 42, as shown in FIG. 3.

As embodied herein, the mounting bracket 19 is mechanically connected to the electrical connector element 12 for mechanically mating the connector 11 to the electrical fixture fitting 42. In a preferred embodiment of the invention, the base portion 20 of the mounting bracket 19 includes a first mounting interface 22, as shown in FIG. 3, for mechanically connecting the electrical connector element 12 and the mounting bracket 19.

In accordance with the invention, the electrical adaptor 10 includes first mounting means for mechanically connecting the electrical connector element 12 to the mounting bracket 19. In a preferred embodiment of the invention, an example of the first mounting means is shown in FIG. 4 as 24. As embodied herein, the first mounting means 24 can be a screw fastener. As embodied herein, the first mounting interface 22 can cooperate with the threads of the screw fastener 24 to mechanically connect the connector 12 to the mounting bracket 19, as shown in FIG. 4.

In a preferred embodiment of the invention, a first pad 25 is placed between the electrical connector element 12 and the mounting bracket 19, as shown in FIG. 5. As embodied herein, the first pad 25 is made of an electrically insulating material. The first pad 25 has apertures 26 to permit the passage of the wires 16 and the first mounting means 24 through the first pad 25 as shown in FIG. 3. The first pad 25 helps provide a secure mechanical connection, helps prevent shorting of the electrical adaptor 10, and helps reduce the danger of electric shock.

In accordance with the invention, the electrical adaptor 10 includes mounting means. In a preferred embodiment of the invention, the mounting means is shown in FIG. 5 as 27. As embodied herein, the mounting means 27 includes a electrical wiring box 28 and a fastener 33.

In the preferred embodiment of the invention, the wiring box is shown in FIG. 3 as 28. As embodied herein, the wiring box 28 has a back face 29, a front face 30, one or more second apertures 31 in the back face 29, and second mounting interface 32. The wiring box 28 can be a standard electrical outlet box of the type listed by Underwriters Laboratory as "504G."

In accordance with the present invention, the electrical adaptor includes second mounting means. In the preferred embodiment of the invention, an example of the fastener and of the second mounting means is shown in FIG. 5 as 33. As embodied herein, the fastener or second mounting means can be one or morescrew fasteners 33. In a preferred embodiment of the invention, the wiring box 28 can include a second mounting interface 32, as shown in FIG. 2. As embodied herein, the mounting means 27 is attached to the connector 11 by the fastener or second mounting means 33. The fastener or second mounting means 33 fixes the mounting bracket 19 of the connector 11 to the back face 29 of the wiring box 28 at the second mounting interface 32. As embodied herein, the second mounting interface 32 can accept the threads of the fastener 33 to mechanically connect the the connector 11 to the wiring box 28.

In a preferred embodiment of the invention, the back face 19 of the electrical wiring box 28 has one or more apertures 31 to permit the passage of the wire 16 through the back face 29 of the electrical wiring box 28 to permit connection of the connector 11 with the standard electrical power outlet socket 36, as shown in FIG. 3.

As embodied herein, the electrical adapter includes a second pad 34 made of electrically insulating material, as shown in FIG. 3. The second pad 34 helps facilitate a sound mechanical connection between the mounting bracket 19 and the electrical wiring box 28, helps prevent shorting of the electrical adapter, and helps reduce the danger of electric shock from use of the electrical adaptor 10. The second pad 34 has one or more apertures 35 to permit passage of the wire 16 through the second pad 34.

As embodied herein, the apertures 31 of the electrical wiring box 28 cooperate with the apertures 35 of the second pad 34, with the apertures 23 of the mounting bracket 19, and with the apertures 26 of the first pad 25 to permit passage of the wire 16 between the connector 11 and the standard electrical power outlet 36, as shown in FIG. 3.

In a preferred embodiment of the invention, the front face 30 of the electrical wiring box 28 is adapted to hold the electrical outlet 36. The mounting of the outlet 36 in the front face of the electrical wiring box 28 can be accomplished by means of a bracket 37 and screw fastener 38 as shown in FIG. 3.

In accordance with the present invention, the electrical adaptor 10 includes conduction means. In a preferred embodiment of the invention, an example of the conduction means is shown in FIG. 3 as 39. As embodied herein, the conduction means 39 is a screw post terminal of the electrical outlet 36. The output terminal 17 of the wire 16 is connected to the electrical outlet 36 by the screw post 39 for electrically connecting the connector 11 to the electrical outlet 36.

In a preferred embodiment of the invention, the installation of the electrical outlet 36 in the front face 30 of the wiring box 28 is shown in FIG. 6. In the preferred embodiment of the invention, as shown in FIG. 6, a cover plate 40 can be fitted over the electrical outlet 36 and fastened by means of a screw fastener 41.

It will be apparent to those skilled in the art that various modifications can be made in the electrical adaptor of the present invention without departing from the scope or spirit of the invention. As an example, various types of connector 11, electrical connector element 12, or mounting bracket 19 can be substituted for those detailed in the above description to enable the electrical adaptor of the present invention to be used with various types of electrical fixture fittings. Similarly, the wiring box 28 and outlet 36 could be modified to provide various types of electrical power outlets which may be desired. Thus, it is intended that the present invention cover the modifications and variations of this invention provided they come within the scope of the appended claims and their equivalents.

What is claimed is:

1. An electrical adaptor for providing an electrical power outlet in a parking garage having one or more electrical fixture fittings, comprising:

a. An electrical connector element having
   (1) an electrical contact;
   (2) a wire for electrical connecting said electrical connector element to the electrical power outlet; and
   (3) a housing;

b. A mounting bracket, mechanically connected to said electrical connector, having
   (1) a flange for being removably connected and mechanically mated with the electrical fixture fitting, and
   (2) a first mounting interface for mechanically mating to said electrical connector element;
   (3) an aperture to permit passage of said wire; and
   (4) a base portion;

c. A first mounting means for mechanically connecting said electrical connector element to said mounting bracket;

d. A wiring box, having
   (1) a back face which is adapted to being mechanically connected with said mounting bracket; and
   (2) a front face which is adapted to hold an electrical power outlet; and
   (3) an aperture in said back face to permit passage of said wire; and e. Second mounting means for mechanically connecting said mounting bracket to said back face of said electrical wiring box.

2. An electrical adaptor as claimed in claim 1 wherein said electrical connector element is a male electrical connector.

3. An electrical adaptor as claimed in claim 1 wherein said first mounting means comprises a screw fastener.

4. An electrical adaptor as claimed in claim 1 wherein said electrical wiring box is an electrical outlet box.

5. An electrical adaptor as claimed in claim 1 wherein second mounting means is a screw fastener.

6. An electrical adaptor for converting an electrical fixture fitting to a standard electrical power outlet to which various electrical equipment can be connected by a standard electrical power plug comprising:

a. electrical connector means for mating electrically with the electrical fixture fitting, having
   (1) electrical contact means for mating electrically with the electrical fixture fitting, said electrical contact means being disposed in said mated position in substantially parallel relation to the surface to which the electrical fixture fitting is mounted, and
   (2) conduction means for electrically connecting said electrical contact to the standard electrical power outlet;

b. a mounting bracket for mating mechanically with the electrical fixture fitting, said mounting bracket being disposed in said mated position in substantially parallel relation to said electrical contact means and to the surface to which the electrical fixture fitting is mounted, said mounting bracket having a flange portion along an edge of said mounting bracket for mechanically mating with the electrical fixture fitting, said flange portion being disposed in said mated position in substantially parallel relation to said electrical contact means and to the surface to which the electrical fixture fitting is mounted;

c. first mounting means for mechanically connecting said electrical connector means to said mounting bracket;

d. an electrical wiring box, having first and second surfaces,
   (1) said first surface mechanically connected with said mounting bracket,
   (2) said second surface in which the standard electrical power outlet is mounted; and e. second mounting means for mechanically mounting said mounting bracket to said first surface of said wiring box.

7. An electrical adaptor as claimed in claim 6 wherein said electrical connector means is a male electrical connector.

8. An electrical adaptor as claimed in claim 6 wherein said first mounting means comprises a screw fastener.

9. An electrical adaptor as claimed in claim 6 wherein said electrical wiring box is a standard electrical outlet box.

10. An electrical adaptor as claimed in claim 6 wherein said second mounting means is a screw fastener.

11. An electrical adaptor for use in a facility wherein electrical power outlet sockets are not readily available for converting a surface mounted electric lighting fixture fitting to a standard electrical power outlet socket to which various electrical equipment can be connected, comprising:

a. an electrical connector element for mating electrically with the electric lighting fixture fitting, having
   (1) an electrical contact having distal and proximal ends, said electrical contact being disposed in said mated position in substantially parallel relation to the surface to which the electric lighting fixture fitting is mounted, said distal end of said electrical contact establishing electrical contact with the electric lighting fixture fitting,
   (2) conduction means for electrically connecting said electrical contact to the standard electrical power outlet socket, and
   (3) a housing, in which said proximal end of said electrical connector element is mounted;

b. a mounting bracket for mating mechanically with said electrical lighting fixture fitting, said mounting bracket being disposed in said mated position in substantially parallel relation to the surface to which the electrical lighting fixture fitting is mounted, said mounting bracket having (1) a flange portion along an edge of said mounting bracket for mechanically mating with the electric lighting fixture fitting, said flange portion being disposed in said mated position in substantially parallel relation to said electrical contact and to the surface to which the electric lighting fixture fitting is mounted, (2) a first mounting interface for mechanically mating to said electrical connector element, (3) an aperture to permit passage of said conduction means, and (4) a base portion;

c. first mounting means for mechanically connecting in non-rotatable, fixed relation said electrical connector element to said mounting bracket;

d. an electrical wiring box, having first and second surfaces, (1) said first surface mechanically connected with said mounting bracket, (2) said second surface in which the standard electrical power outlet socket is mounted, and (3) an aperture formed in said electrical wiring box to permit passage of said conduction means; and e. second mounting means for mechanically mounting in non-rotatable, fixed relation the base portion of said mounting bracket to said first surface of said wiring box.

12. An electrical adaptor as claimed in claim 11 wherein said electrical connector element is a male electrical connector.

13. An electrical adaptor as claimed in claim 11 wherein said first mounting means comprises a screw fastener.

14. An electrical adaptor as claimed in claim 11 wherein said electrical wiring box is a standard electrical outlet box.

15. An electrical adaptor as claimed in claim 11 wherein said second mounting means is a screw fastener.

* * * * *